US007559881B1

(12) United States Patent
Roraff

(10) Patent No.: US 7,559,881 B1
(45) Date of Patent: Jul. 14, 2009

(54) EXERCISE ASSEMBLY FOR CONDITIONING A USER'S BODY AND ASSOCIATED METHOD

(76) Inventor: Jack J. Roraff, HC032 Box 116 Main St., East Carbon City, UT (US) 84520

( * ) Notice: Subject to any disclaimer, the term of this patent is extended or adjusted under 35 U.S.C. 154(b) by 0 days.

(21) Appl. No.: 12/075,225

(22) Filed: Mar. 11, 2008

(51) Int. Cl.
*A63B 21/04* (2006.01)
*A63B 21/02* (2006.01)

(52) U.S. Cl. ..... 482/129; 482/126

(58) Field of Classification Search ..... 482/77, 482/85, 121, 122, 126, 128, 129; 472/135
See application file for complete search history.

(56) References Cited

U.S. PATENT DOCUMENTS 3,724,450 A * 4/1973 Chaitin ..... 601/31
3,747,925 A * 7/1973 Seeger ..... 482/121
3,782,721 A * 1/1974 Passera ..... 482/117
3,802,701 A * 4/1974 Good, Jr. ..... 482/119
4,249,727 A * 2/1981 Dehan ..... 482/117
4,275,881 A * 6/1981 Armstrong ..... 482/77
4,351,527 A * 9/1982 Crisp, Jr. ..... 482/122
4,494,662 A * 1/1985 Clymer ..... 482/123
4,834,364 A * 5/1989 Gongwer et al. ..... 482/131
5,637,062 A * 6/1997 Schmittner ..... 482/97
5,700,232 A * 12/1997 Clausen et al. ..... 482/125
5,820,520 A 10/1998 Sieber
5,839,991 A * 11/1998 Hall ..... 482/23
7,125,365 B2 * 10/2006 Krietzman ..... 482/112
2002/0151416 A1 * 10/2002 List ..... 482/121
2007/0197355 A1 * 8/2007 Brown ..... 482/111
2007/0238588 A1 * 10/2007 Butler ..... 482/70

* cited by examiner

*Primary Examiner*—Loan H Thanh
*Assistant Examiner*—Allana Lewin

(57) ABSTRACT

An exercise apparatus includes a base member, an elongated and rectilinear central shaft with axially opposed top and bottom ends, first and second couplings attached to the top and bottom ends respectively, first and second handles coupled to the first coupling and extending outwardly away from the central shaft, first and second leg rails attached to the second coupling and extending laterally away from the central shaft, and a rectilinear auxiliary shaft with axially opposed top and bottom ends connected to the second coupling and the base member respectively. The apparatus further includes a mechanism for rotatably connecting the auxiliary shaft to the base member, and a bracket adjustably and selectively mated along a longitudinal length of the central shaft.

6 Claims, 4 Drawing Sheets

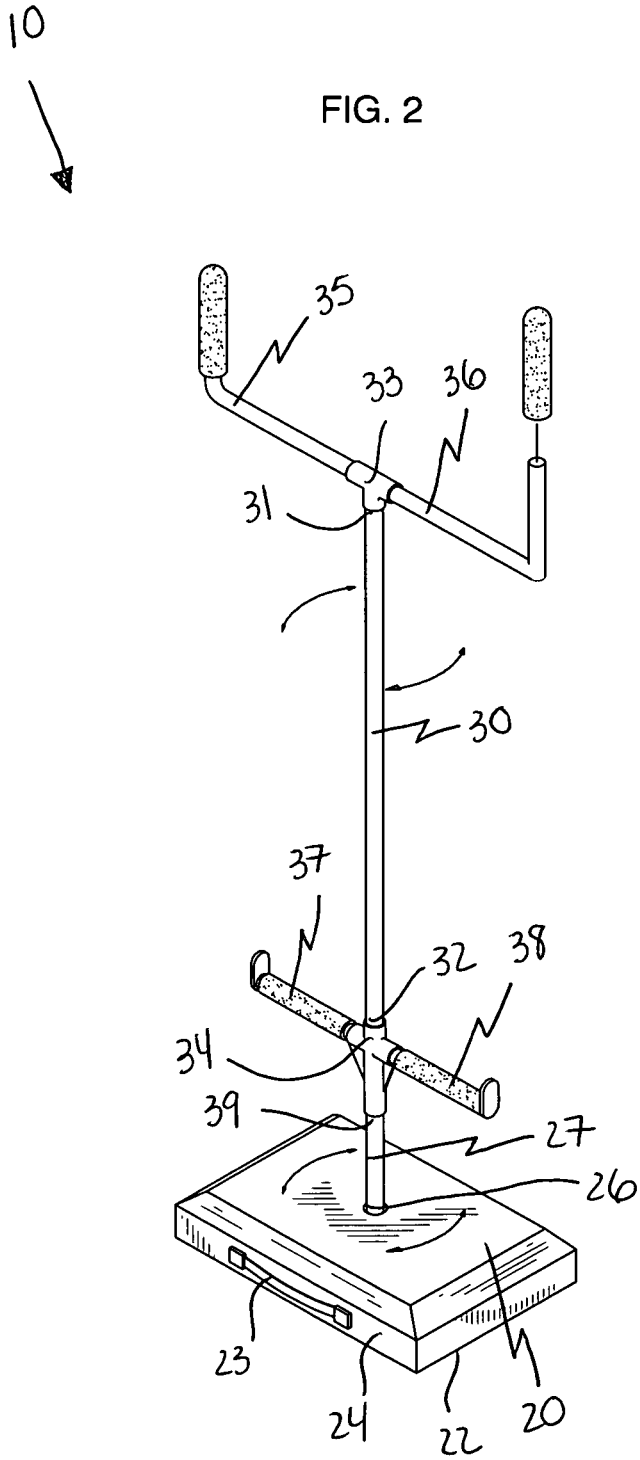
FIG. 2
FIG. 3
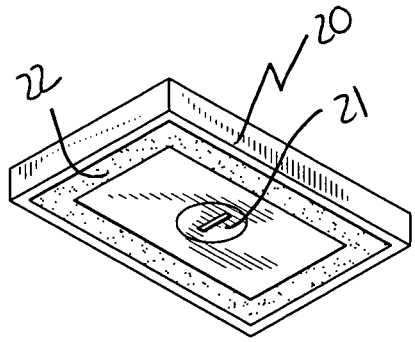

EXERCISE ASSEMBLY FOR CONDITIONING A USER'S BODY AND ASSOCIATED METHOD

CROSS REFERENCE TO RELATED APPLICATIONS

This application claims the benefit of U.S. Provisional Application No. 60/881,377, filed Jan. 22, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to exercise equipment and, more particularly, to an exercise apparatus for assisting a user to lose weight and tone muscles.

2. Prior Art

A variety of activities and sports require a rotary motion in a person's total body. In everyday activities, a person does not generally use or exercise these muscles. A variety of exercise devices have been introduced in the prior art for conditioning those muscles used in twisting or turning the body. While these devices have been produced for this general purpose, they generally suffer from one or more deficiencies that do not make them acceptable for use substantially anywhere by the average person.

For example, some such devices are designed so that the subject must assume an unnatural position when using them, which limits their effectiveness and can even cause physical injury. In other available devices permanent installation is required, a feature unacceptable in many homes and offices, and the devices are either non-adjustable, or can be adjusted only by a fairly complicated arrangement. In addition, some presently available devices are ungainly in appearance, and are relatively expensive to purchase.

U.S. Pat. No. 3,802,701 to Good discloses a platform with a vertically mounted, adjustable rotary resistance unit thereon, to which the lower end of the center leg of a vertically disposed T-shaped handle is connected. A subject standing on the platform grips the cross bars of the handle, and rotates the handle back and forth against the force of the resistance unit, thereby exercising selected body muscles. A torque frictional resistance is developed by the resistance unit against the twisting of the center leg by a user acting on the cross bar. The resistance unit has an adjustable clamp that grips a rotor on the lower end of the center leg to vary the frictional resistance to the rotation of the rotor. An anchored vertical bar may be used to lockingly engage the lower most portion of the T-shaped handle so as to offer resistance to twisting of the T-shaped handle. An adjustable collar may be provided on the vertical bar to vary the amount of torque necessary to twist the vertical bar. Unfortunately, this prior art example does not enable a user to complete exercises while comfortably seated in front of the television.

U.S. Pat. No. 4,249,727 to Dehan discloses a gymnastic apparatus designed to strengthen the muscles of the abdomen at waist level, those located in the small of the back and in the buttocks and to exercise and maintain all of the rest of the body's muscles. The apparatus includes a base, a bar which can be moved in any direction, one of whose ends is fitted with a sleeve, and whose other end is connected to the base by means of a connection mechanism. The connection mechanism includes a ball holding the end of the bar which is housed in a tube whose upper end is shaped to match the upper end of the ball, with the lower end of the tube being secured to the base. Said ball can move in all directions in response to movement imparted to the ball, within a space limited by the upper end of the tube and by a part forming a seat for the ball mounted on the base by means of an adjustment mechanism making it possible to adjust friction of the ball. Unfortunately, this prior art example does not enable a user to effectively exercise while seated in a comfortable chair.

U.S. Pat. No. 5,820,520 to Sieber discloses an exercise apparatus which includes a gripping or handle assembly which is grasped at each of its ends by a user's hands. The handle assembly is rotatably mounted on a support having a configuration selected so that when the ends of the handle assembly are grasped by the user, the user is in a position with his hands positioned above his shoulders. The handle is then rotated by the user pulling on one end of the assembly and then the other end, to pivot the handle assembly about a pivot point and stretch the various upper body muscles. Unfortunately, this prior art example is not designed for exercising both the upper and lower muscles of a user's body.

Accordingly, the present invention is disclosed in order to overcome the above noted shortcomings. The exercise apparatus is convenient and easy to use, lightweight yet durable in design, and designed for assisting a user to lose weight and tone muscles. The apparatus is simple to use, inexpensive, and designed for many years of repeated use.

BRIEF SUMMARY OF THE INVENTION

In view of the foregoing background, it is therefore an object of the present invention to provide an apparatus for assisting a user to lose weight and tone muscles. These and other objects, features, and advantages of the invention are provided by an exercise apparatus.

An exercise apparatus includes a base member with an access panel removably attached to a bottom surface thereof. Such a base member further has a handle directly connected to a sidewall thereof and is effectively provided with a cavity formed therein. A bottom end of an auxiliary shaft is partially disposed within the cavity, and an anchor rod and springs are completely disposed within the cavity.

The apparatus further includes an elongated and rectilinear central shaft with axially opposed top and bottom ends, first and second couplings conveniently attached to the top and bottom ends respectively, first and second handles coupled to the first coupling and extending outwardly away from the central shaft, first and second leg rails attached to the second coupling and extending laterally away from the central shaft, and a rectilinear auxiliary shaft with axially opposed top and bottom ends connected to the second coupling and the base member respectively.

The apparatus further includes a mechanism for rotatably connecting the auxiliary shaft to the base member in such a manner that the auxiliary shaft and the central shaft advantageously return to a vertically oriented equilibrium position after being offset from a vertical axis while being simultaneously rotated about the vertical axis. Such a rotatably connecting mechanism includes an anchor rod directly and statically conjoined to the bottom end of the auxiliary shaft, an outer ring concentrically positioned about the anchor rod and fixedly engaged to the base member, a sleeve fitted over a bottom tip of the anchor rod, and a plurality of deformably resilient springs with opposed ends anchored directly to the outer ring and the sleeve respectively. Each of the springs cooperatively extends and contracts along a respective linear path when the auxiliary and central shafts are pivoted along a corresponding arcuate path and is linearly oriented along a horizontal plane and disposed orthogonally to the anchor rod. The springs are equidistantly juxtaposed along an inner perimeter of the outer ring and maintain direct and continuous contact with the sleeve while the anchor rod is offset from the vertical axis.

The exercise apparatus further includes a bracket adjustably and selectively mated along a longitudinal length of the central shaft. Such a bracket includes a pair of laterally extending ribs and first and second cables with opposed ends effectively anchored to the ribs and lateral ends of the leg rails respectively such that the first and second cables diverge downwardly away from the central shaft and terminate at the leg rails.

A method for reducing user body weight includes the steps of: providing an exercise apparatus; positioning the exercise apparatus adjacent to a front end of a chair; sitting on the chair and facing the exercise apparatus; positioning a base member of the exercise apparatus between feet of the user; placing user hands on handles bars of the exercise apparatus; placing user feet on leg rails of the exercise apparatus; and rotating the user body along a selected arcuate path.

The method further includes the steps of: simultaneously pushing a left one of the user feet and a left one of user hands forwardly; simultaneously pushing a right one of the user feet and a right one of user hands forwardly; moving the user feet to an inner edge of the leg rails by touching a central shaft of the exercise apparatus; leaning forward as far as possible by pushing forwardly on the central shaft; and leaning backward as far as possible by pulling backwardly on the central shaft.

The method further includes the steps of: moving the user feet to an outer edge of the leg rails by touching a central shaft of the exercise apparatus; moving forward on the chair; tilting the central shaft leftward as far as possible by engaging the lateral edge of a left one of the leg rails with a floor surface; and tilting the central shaft rightward as far as possible by engaging the lateral edge of a right one of the leg rails with the floor surface.

The method further includes the steps of: while firmly engaging the handle bars, lifting the exercise apparatus above a head of the user; and lowering the exercise apparatus downwardly in front of the user by stretching forward and reaching out as far as possible until the base member touches a floor surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 2 is a perspective view of an alternate embodiment of the exercise apparatus, in accordance with the present invention;

FIG. 3 is a bottom planar and perspective view of the base member, in accordance with the present invention;

DETAILED DESCRIPTION OF THE INVENTION

Figure 1:
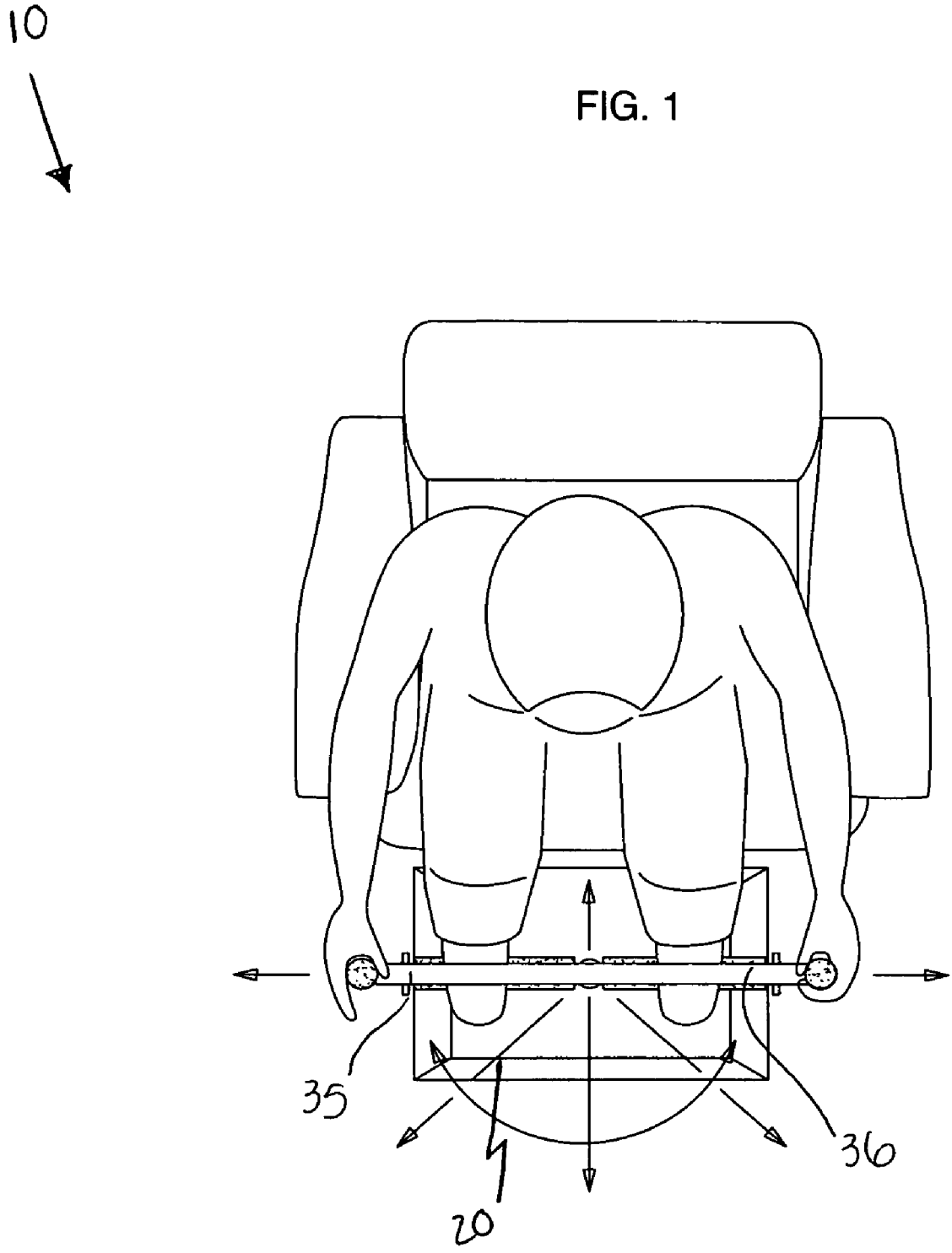
FIG. 1 is top planar view of an exercise apparatus in use, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-8 by the reference numeral 10 and is intended to protect an exercise apparatus. It should be understood that the apparatus 10 may be used to perform many different types of exercises and should not be limited to use with only those types of exercises mentioned herein.

Referring initially to FIGS. 1, 2, 3, 4, 7 and 8, an exercise apparatus 10 includes a base member 20 with an access panel 21 removably attached to a bottom surface 22 thereof. Such a base member 20 further has a handle 23 directly connected, without the use of intervening elements, to a sidewall 24 thereof and is provided with a cavity 25 formed therein. A bottom end 26 of an auxiliary shaft 27 is partially disposed within the cavity 25, and an anchor rod 28 and springs 29 are completely disposed within the cavity 25. The handle 23 of the base member 20 will enable a user to easily transport the apparatus from one location to another.

Figure 4:
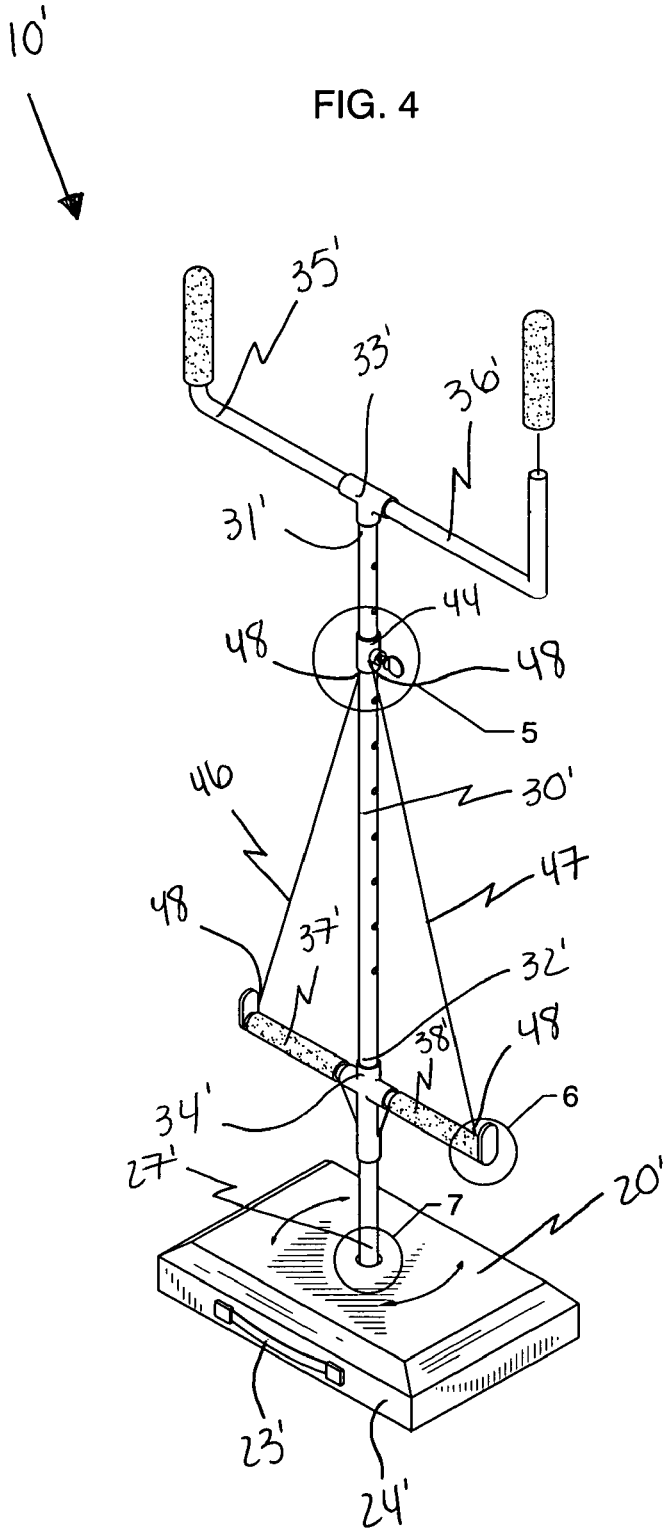
FIG. 4 is a perspective view of the exercise apparatus, in accordance with the present invention.

Referring to FIGS. 1, 2 and 4, the apparatus 10 further includes an elongated and rectilinear central shaft 30 with axially opposed top and bottom ends 31, 32, first and second couplings 33, 34 attached to the top and bottom ends 31, 32 respectively, first and second handles 35, 36 coupled to the first coupling 33 and extending outwardly away from the central shaft 30, first and second leg rails 37, 38 attached to the second coupling 34 and extending laterally away from the central shaft 30, and the rectilinear auxiliary shaft 27 with axially opposed top and bottom ends 39, 26 connected to the second coupling 34 and the base member 20 respectively.

Figure 7:
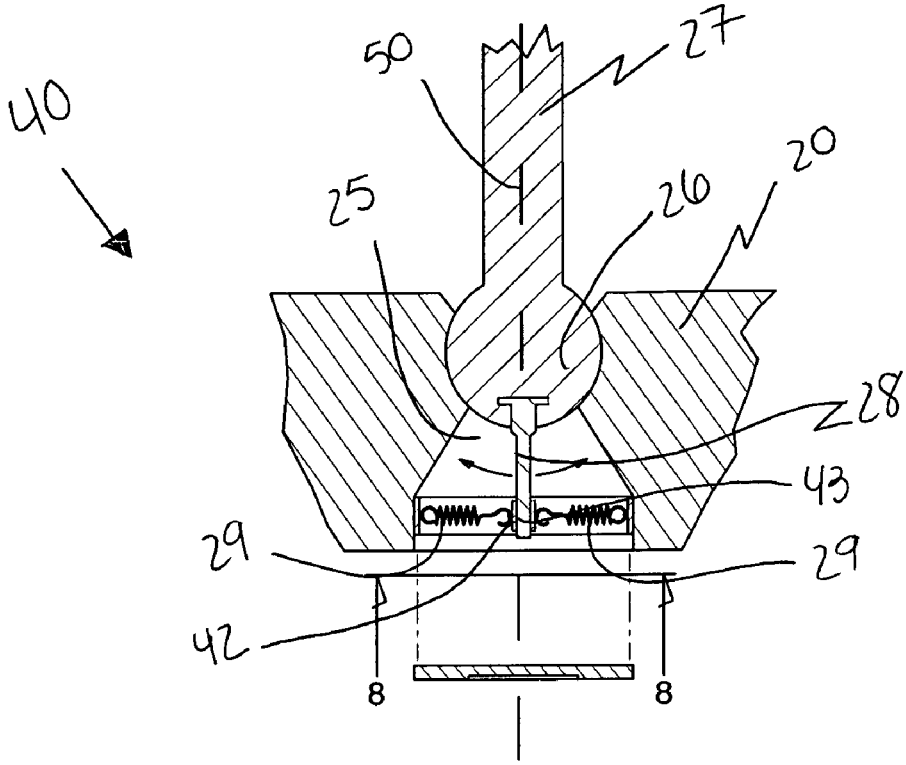
FIG. 7 is a cross sectional view of the rotatably connecting mechanism, in accordance with the present invention.
Figure 8:
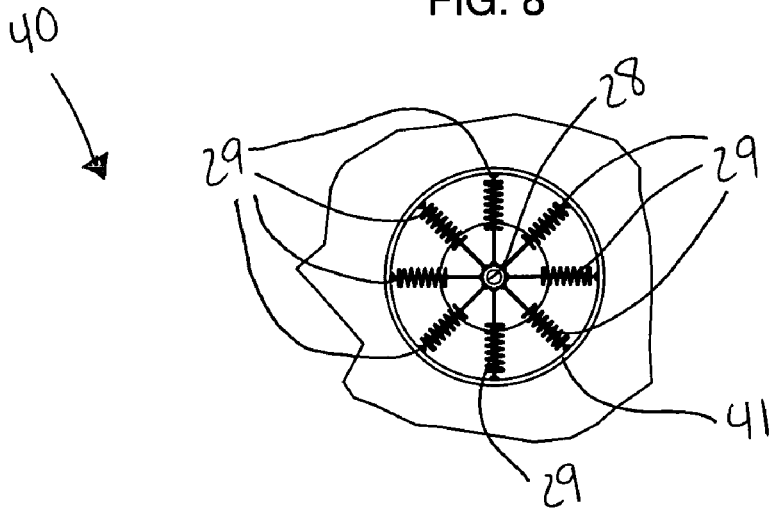
FIG. 8 is a bottom planar view of the rotatably connecting mechanism, as seen in FIG. 7.

Referring to FIGS. 7 and 8, the apparatus 10 further includes a mechanism 40 for rotatably connecting the auxiliary shaft 27 to the base member 20 in such a manner that the auxiliary shaft 27 and the central shaft 30 return to a vertically oriented equilibrium position after being offset from a vertical axis 50 while being simultaneously rotated about the vertical axis. Such a rotatably connecting mechanism 40 includes the anchor rod 28 directly and statically, without the use of intervening elements, conjoined to the bottom end 26 of the auxiliary shaft 27, an outer ring 41 concentrically positioned about the anchor rod 28 and fixedly engaged to the base member 20, a sleeve 42 fitted over a bottom tip 43 of the anchor rod 28, and a plurality of deformably resilient springs 29 with opposed ends anchored directly, without the use of intervening elements, to the outer ring and the sleeve respectively. Each of the springs 29 cooperatively extends and contracts along a respective linear path when the auxiliary and central shafts 27, 30 are pivoted along a corresponding arcuate path and are linearly oriented along a horizontal plane and disposed orthogonally to the anchor rod 28. The springs 29 are equidistantly juxtaposed along an inner perimeter of the outer ring 41 and maintain direct and continuous contact with the sleeve 42 while the anchor rod 28 is offset from the vertical axis.

Figure 5:
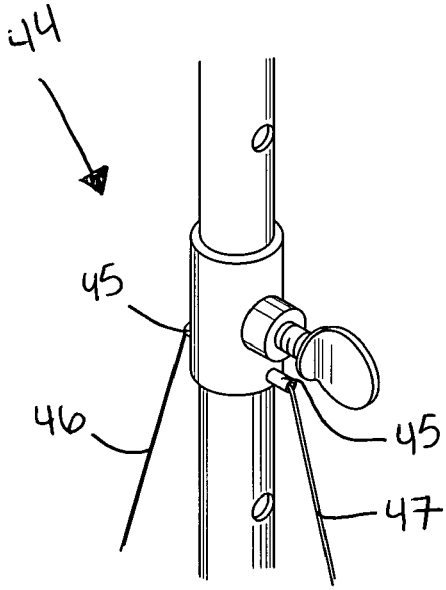
FIG. 5 is an enlarged view of a the bracket, as seen in FIG. 4.
Figure 6:
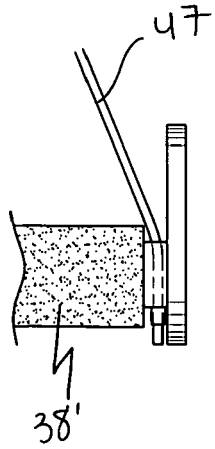
FIG. 6 is an enlarged view of the lateral end of a leg rail, as seen in FIG. 4.

Referring to FIGS. 4, 5 and 6, the exercise apparatus 10 further includes a bracket 44 adjustably and selectively mated along a longitudinal length of the central shaft 30. Such a bracket 44 includes a pair of laterally extending ribs 45 and first and second cables 46, 47 with opposed ends 48 anchored to the ribs 45 and lateral ends of the leg rails 37, 38 respectively which is essential such that the first and second cables 46, 47 diverge downwardly away from the central shaft 30 and terminate at the leg rails 37, 38.

The apparatus includes a frame that consists of a plurality of durable, interconnected pieces of tubular plastic polyvinyl chloride (PVC) material. Such a frame measures approximately thirty-four inches in height and twenty-two inches in total width. A horizontal base with two extensions jutting upward therefrom is directly attached, without the use of intervening elements, to the top end of the frame, thus resembling a set of handlebars. Such extensions are sheathed in a soft, rubberized material that is important for facilitating a firm grip as well as provide a comfortable hold when the assembly is in use. A central one of the tubular frame pieces extends downward and has a horizontal extension directly attached thereto, without the use of intervening elements, which effectively serves as the foot brace of the assembly. A rubberized material is attached to such a horizontal extension that conveniently provides traction for the user's feet during use.

An independent mounting base is included with the apparatus, and includes a centrally positioned socket for effectively anchoring the apparatus when it is used. Such a base is produced out of durable plastic material and has a rubberized, non-slip material directly attached, without the use of intervening elements, to the bottom thereof. The base is rectangular-shaped and measures twelve inches in length, nine inches in width, and 1½ inch thick. The socket for anchor the frame is ½ inch in depth. A convenient carrying handle is directly attached to the base, without the use of intervening elements, which is crucial and advantageous for enhancing the portability of the assembly.

In use, the exercise apparatus is simple and straightforward to operate. First, the user takes a seat in a favorite chair, whether a loveseat, recliner or sofa. After positioning the assembly's base between the feet, the user inserts the bottom of the apparatus' stem into the base socket to anchor the frame. Next, the user grips the upper extensions, or handlebars, and their feet are placed onto the lower horizontal bar. A simple exercise for beginners consists of pushing the apparatus forward, pulling it right then left, and back towards the person. This conveniently helps to build the arms and legs, and can be repeated as many times as the user finds comfortable.

The present invention, as claimed, provides the unexpected and unpredictable benefit of an apparatus that is convenient and easy to use, is durable yet lightweight in design, and provides users with a simple, low-cost, and un-encumbering means of engaging in physical activity. As a lightweight, hand-and-foot operated device, the present invention allows virtually any user to tone any area of the body at any time of day, without having to leave the house. Since it is extremely easy to use, busy adults are advantageously able to complete exerciser regimens with the present invention while sitting comfortably on a sofa or in a recliner, achieving an optimal workout as they watch television or simply converse with family and friends. As a result, the apparatus conveniently eliminates the need for other workout regimens and trips to the gym that take up valuable time as well as money.

In use, a method for reducing user body weight includes the steps of: providing an exercise apparatus 10; positioning the exercise apparatus 10 adjacent to a front end of a chair; sitting on the chair and facing the exercise apparatus 10; positioning a base member 20 of the exercise apparatus 10 between feet of the user; placing user hands on handles bars 35, 36 of the exercise apparatus 10; placing user feet on leg rails 37, 38 of the exercise apparatus 10; and rotating the user body along a selected arcuate path.

In use, the method further includes the steps of: simultaneously pushing a left one of the user feet and a left one of user hands forwardly; simultaneously pushing a right one of the user feet and a right one of user hands forwardly; moving the user feet to an inner edge of the leg rails 37, 38 by touching a central shaft of the exercise apparatus 10; leaning forward as far as possible by pushing forwardly on the central shaft 30; and leaning backward as far as possible by pulling backwardly on the central shaft 30.

In use, the method further includes the steps of: moving the user feet to an outer edge of the leg rails 37, 38 by touching a central shaft 30 of the exercise apparatus 10; moving forward on the chair; tilting the central shaft 30 leftward as far as possible by engaging the lateral edge of a left one of the leg rails with a floor surface; and tilting the central shaft 30 rightward as far as possible by engaging the lateral edge of a right one of the leg rails with the floor surface.

In use, the method further includes the steps of: while firmly engaging the handle bars 35, 36, lifting the exercise apparatus 10 above a head of the user; and lowering the exercise apparatus 10 downwardly in front of the user by stretching forward and reaching out as far as possible until the base member 20 touches a floor surface.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. An exercise apparatus for assisting a user to lose weight and tone muscles, said exercise apparatus comprising:

a base member;

an elongated and rectilinear central shaft having axially opposed top and bottom ends;

first and second couplings attached to said top and bottom ends respectively;

first and second handles coupled to said first coupling and extending outwardly away from said central shaft;

first and second leg rails attached to said second coupling and extending laterally away from said central shaft;

a rectilinear auxiliary shaft having axially opposed top and bottom ends connected to said second coupling and said base member respectively;

means for rotatably connecting said auxiliary shaft to said base member in such a manner that said auxiliary shaft and said central shaft return to a vertically oriented equilibrium position after being offset from a vertical axis while being simultaneously rotated about the vertical axis;

an anchor rod directly and statically conjoined to said bottom end of said auxiliary shaft;

an outer ring concentrically positioned about said anchor rod and fixedly engaged to said base member;

a sleeve fitted over a bottom tip of said anchor rod; and a plurality of deformably resilient springs having opposed ends anchored directly to said outer ring and said sleeve respectively;

wherein each of said springs cooperatively extends and contracts along a respective linear path when said auxiliary and central shafts are pivoted along a corresponding arcuate path.

2. The exercise apparatus of claim 1, wherein said base member is provided with a cavity formed therein, said bottom end of said auxiliary shaft being partially disposed within said cavity, said anchor rod and said springs being completely disposed within said cavity.

3. The exercise apparatus of claim 1, wherein each of said springs is linearly oriented along a horizontal plane and disposed orthogonally to said anchor rod.

4. The exercise apparatus of claim 1, wherein said springs are equidistantly juxtaposed along an inner perimeter of said outer ring and maintain direct and continuous contact with said sleeve while said anchor rod is offset from the vertical axis.

5. The exercise apparatus of claim 1, further comprising:

a bracket adjustably and selectively mated along a longitudinal length of said central shaft, said bracket including a pair of laterally extending ribs; and first and second cables having opposed ends anchored to said ribs and lateral ends of said leg rails respectively such that said first and second cables diverge downwardly away from said central shaft and terminate at said leg rails.

6. An exercise apparatus for assisting a user to lose weight and tone muscles, said exercise apparatus comprising:

a base member having an access panel removably attached to a bottom surface thereof, said base member further having a handle directly connected to a sidewall thereof;

an elongated and rectilinear central shaft having axially opposed top and bottom ends;

first and second couplings attached to said top and bottom ends respectively;

first and second handles coupled to said first coupling and extending outwardly away from said central shaft;

first and second leg rails attached to said second coupling and extending laterally away from said central shaft;

a rectilinear auxiliary shaft having axially opposed top and bottom ends connected to said second coupling and said base member respectively; and means for rotatably connecting said auxiliary shaft to said base member in such a manner that said auxiliary shaft and said central shaft return to a vertically oriented equilibrium position after being offset from a vertical axis while being simultaneously rotated about the vertical axis.

* * * * *